US008833888B2

(12) United States Patent
Teranishi

(10) Patent No.: US 8,833,888 B2
(45) Date of Patent: Sep. 16, 2014

(54) INKJET RECORDING DEVICE

(75) Inventor: Norihisa Teranishi, Fukui (JP)

(73) Assignee: Seiren Co., Ltd., Fukui (JP)

( * ) Notice: Subject to any disclaimer, the term of this patent is extended or adjusted under 35 U.S.C. 154(b) by 21 days.

(21) Appl. No.: 13/636,908

(22) PCT Filed: Mar. 18, 2011

(86) PCT No.: PCT/JP2011/056529

§ 371 (c)(1),
(2), (4) Date: Sep. 24, 2012

(87) PCT Pub. No.: WO2011/118516

PCT Pub. Date: Sep. 29, 2011

(65) Prior Publication Data

US 2013/0016144 A1 Jan. 17, 2013

(30) Foreign Application Priority Data

Mar. 26, 2010 (JP) ..... 2010-072129

(51) Int. Cl.
*B41J 29/38* (2006.01)
*B41J 19/00* (2006.01)
*B41J 2/045* (2006.01)

(52) U.S. Cl.
CPC ..... *B41J 19/005* (2013.01); *B41J 2/04528* (2013.01); *B41J 2/04563* (2013.01); *B41J 2/04541* (2013.01); *B41J 2/04533* (2013.01)
USPC ..... 347/9

(58) Field of Classification Search
CPC ... B41J 2/0458; B41J 2/04541; B41J 2/04543
USPC ..... 347/5–20, 101
See application file for complete search history.

(56) References Cited

U.S. PATENT DOCUMENTS

2006/0139383 A1* 6/2006 Hayasaki ..... 347/5
2007/0279449 A1* 12/2007 Mori et al. ..... 347/20
2008/0239389 A1* 10/2008 Kudo ..... 358/1.15

FOREIGN PATENT DOCUMENTS

JP 6-15918 A 1/1994
JP 2003-136698 A 5/2003

(Continued)

OTHER PUBLICATIONS

Extended European Search Report dated May 21, 2014, issued by the European Patent Office in corresponding European Application No. 11759322.8.

*Primary Examiner* — Manish S Shah
*Assistant Examiner* — Roger W Pisha, II
(74) *Attorney, Agent, or Firm* — Sughrue Mion, PLLC

(57) ABSTRACT

An object of the present invention is to provide an inkjet recording apparatus capable of simplifying cables for transmitting a recording signal to a plurality of inkjet heads. The inkjet recording device has a plurality of head units 10 including: a plurality of inkjet heads 200; drive circuits 201 being provided corresponding to each of the ink jet heads 200 and drive-controlling inkjet operations; a power supply circuit 310 supplying a voltage required to discharge ink to the drive circuit 201; a recording control circuit 300 controlling the drive circuit 201 and the power supply circuit 310 based on recording control data; and a transmitting and receiving circuit 330 acquiring the recording control data via a network based on address data and transmitting the data to the recording control circuit 300, to thereby perform recording operations based on the recording control data transmitted to the head unit 10 through the network.

7 Claims, 3 Drawing Sheets

(56) References Cited

FOREIGN PATENT DOCUMENTS

| | | | |
|---|---|---|---|
| JP | 2005111936 | A | 4/2005 |
| JP | 2006-243859 | A | 9/2006 |
| JP | 2007-62264 | A | 3/2007 |
| JP | 2008230123 | A | 10/2008 |

* cited by examiner

INKJET RECORDING DEVICE

CROSS REFERENCE TO RELATED APPLICATIONS

This application is a National Stage of International Application No. PCT/JP2011/056529, filed on Mar. 18, 2011, which claims priority from Japanese Patent Application No. 2010-072129, filed on Mar. 26, 2010, the contents of all of which are incorporated herein by reference in their entirety.

TECHNICAL FIELD

The present invention relates to an inkjet recording apparatus that performs recording on a recording medium by using a plurality of inkjet heads.

BACKGROUND ART

An inkjet recording system discharges minute ink droplets from an ink discharge port (a nozzle) of an inkjet head to a work (an object to be recorded), to thereby perform printing or image recording. Since the inkjet recording system can perform recording operations in a state of being spaced apart from works, recording on works made of various materials is possible, and thus the system is used for a wide range of applications.

In recent years, the inkjet recording system has allowed more highly precise recording than other recording systems, and thus the inkjet recording system has been adopted also in a manufacturing process of, for example, color filters, organic electro luminescence (EL) displays, and the like which are components of color liquid crystal displays used as display units for color TVs and personal computers. Furthermore, application to a manufacturing process of electronic devices, such as thin film transistors, wiring boards and micro lens, is under study.

In recording characters or images on recording medium such as paper, generally, ink of four colors: black, cyan, magenta and yellow is used, and in a manufacturing process of the display units or the like described above, ink including coloring materials of three colors: red, green and blue and luminescent material is used. Generally, the inkjet recording apparatus includes inkjet heads for each type of ink to be used.

The inkjet recording apparatus used in the manufacturing process described above often includes a plurality of inkjet heads provided for one type of ink and also includes, in some case, a few tens to a few hundreds of inkjet heads, from the viewpoint of work size enlargement and higher production efficiency. Furthermore, each inkjet head is provided with nozzles for discharging ink droplets and along with needs of highly dense and highly precise recording quality, the number of nozzles provided on one inkjet head is on the increase and is sometimes in excess of 100.

An on-demand type inkjet recording apparatus makes use of a piezoelectric element in a piezo system or a heater in a thermal system as drive means for discharging ink droplets from nozzles, but in response to the increasing number of nozzles described above, the number of driver circuit boards for drive-controlling the drive means, such as piezoelectric element or heater, also increases.

Generally, the driver circuit boards are integrally attached to inkjet heads or disposed in the vicinity to the inkjet heads. Control circuit boards for transferring recording control signals obtained from recording data to the driver circuit boards are often arranged together, separately from the inkjet heads. Accordingly, in transferring recording data from the control circuit boards to the driver circuit boards, multi-core cables are used and each of the cables from the control circuit boards is connected to a predetermined driver circuit board (refer to Patent Literature 1 and Patent Literature 2).

CITATION LIST

Patent Literature

[Patent Literature 1] Japanese Patent Application Laid-Open No. 6-15918

[Patent Literature 2] Japanese Patent Application Laid-Open No. 2003-136698

DISCLOSURE OF THE INVENTION

Technical Problem

As an inkjet recording apparatus with a plurality of inkjet heads comes to have a larger amount of inkjet heads, the number of cables for connecting between a control circuit board and a driver circuit board of each inkjet head becomes larger, and thus the weight of a head unit on which the inkjet heads is mounted increases. In addition, because bundles of a large amount of cables move along with scanning operations of the head units during recording operations, the cables interfere with the scanning operations of the head units.

Furthermore, in assembling head units or replacing a failed inkjet head, there arises a problem in which maintenance work becomes very troublesome due to burdensome cable handling. For cable connection between a control circuit board and a driver circuit board, it is necessary to connect cables for each driver circuit board, but when the number of cables increases along with the number of the inkjet heads, the possibility that erroneous cable connection occurs becomes higher. Furthermore, when recording operations are performed on a large-sized recording medium and as an inkjet recording apparatus becomes larger, a distance between the control circuit board and a driver circuit board becomes longer and hence the length of a cable needs to be lengthened, but lengthening the cable has an effect on signal characteristics in a cable or causes problems of garbled data or noise of recording signals.

Moreover, the total throughput of recording control also increases corresponding to the increase in the number of inkjet heads and the necessity of providing a plurality of control circuit boards is caused in order to meet increasing throughput. Accordingly, a plurality of control circuit boards is required to be totally controlled.

Therefore, the object of the present invention is to provide an inkjet recording apparatus capable of simplifying cables for transmitting a recording signal to a plurality of inkjet heads.

Solution to Problem

An inkjet recording apparatus according to the present invention has a plurality of head units comprising: a plurality of inkjet heads; a plurality of drive sections being provided corresponding to the ink jet heads and drive-controlling inkjet operation; a power supply section supplying, to each of the drive sections, a required voltage to perform the inkjet operation; a recording control section controlling the plurality of drive sections and the power supply section, based on recording control data; and a transmitting and receiving section acquiring the recording control data via a network based on address data and transmitting the data to the recording control section, wherein the inkjet recording apparatus discharges ink droplets from the inkjet heads based on the recording control data transmitted to the head units via the network, to thereby perform recording on a recording medium. Moreover, a LAN cable is connected to the head unit to perform data transmission and reception via a network. In addition, the power supply section supplies electric power to a heater provided on the inkjet head, to thereby control temperatures of the inkjet head. Furthermore, on the head unit, a storage apparatus for once storing the recording control data is mounted.

Advantages of the Invention

The present invention can simplify cable connection around head units with the structure described above.

That is, because a recording control section for controlling a power supply section and a drive section is mounted on the head unit based on recording control data, connection between the recording control section and the drive section can be made by wiring or the like, thereby achieving disuse of cables. In addition, since transmission of recording control data to the recording control section is implemented through a network, it is only necessary to connect cables used in the network and cable connection is simplified, and thus weight reduction in the head unit can be achieved.

Then, by connecting cables used in a network, the number of cables is much more reduced than in a conventional way, and thus removal of cables is facilitated for easy maintenance of inkjet heads.

Moreover, because data is transmitted and received via a network, if recording control data is transmitted together with an address corresponding to each head unit, all the plurality of head units are controlled for precise recording operations, by causing the head units to perform recording operations based on recording control data.

Then, by connecting head units through a network, it is possible to flexibly deal with the increase/decrease in the number of head units, and data transmission and reception to/from a distant location through the use of the internet or the like are also available, and thus expandability as a system of an inkjet recording apparatus is remarkably improved.

Furthermore, because the recording control section for creating driving data or the like about individual inkjet heads is mounted on the head unit, the drive section and the recording control section are disposed in proximity to each other to thereby allow preventing the generation of garbled data or noise during transmission of driving data or the like, an thus precise recording operations become possible even if the number of inkjet heads of the inkjet recording apparatus increases.

BEST MODES FOR CARRYING OUT THE INVENTION

Hereinafter, an inkjet recording apparatus according to one embodiment of the present invention will be described with reference to the accompanying drawings. Note that, since the embodiment described below is a preferable example in carrying out the present invention, various technical limitations are provided, but no limitations are provided in such an embodiment unless the following description particularly specifies that the present invention is limited.

Figure 1:
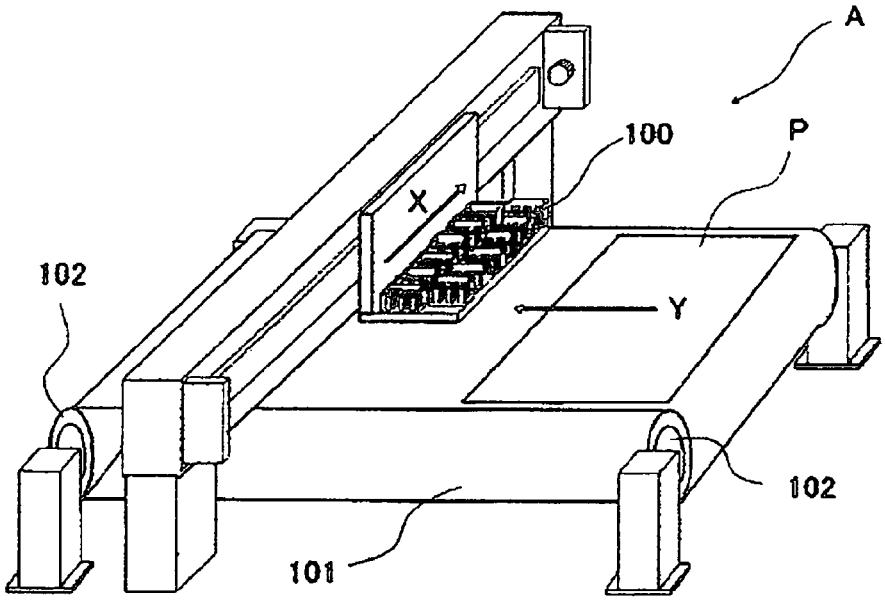
FIG. 1 is a schematic configuration diagram of an inkjet recording apparatus.

FIG. 1 is a schematic configuration diagram of an inkjet recording apparatus A. An inkjet recording section 100 is disposed so as to face a recording surface of a sheet-like recording medium P and an ink discharge port of an inkjet head appears through an opening provided in the bottom face of the inkjet recording section 100. Under the inkjet recording section 100, an endless conveying belt 101 disposed so as to face the ink discharge port is tensed between a pair of conveying rollers 102. Then, a recording medium P is placed on the conveying belt 101 and conveyed in a scanning direction Y. After ink is discharged from the ink discharge port of the ink jet recording section 100 while conveyance of the conveying belt 101 is being controlled in the scanning direction Y and predetermined recording operations are performed on a surface of the recording medium, the inkjet recording section 100 is moved by a predetermined distance in a sub-scanning direction X and the next recording operation is performed while the recording medium P is being conveyed again in the scanning direction Y. By repeating such recording operations and conveyance control, images can be recorded on the whole surface of the recording medium P.

Figure 2:
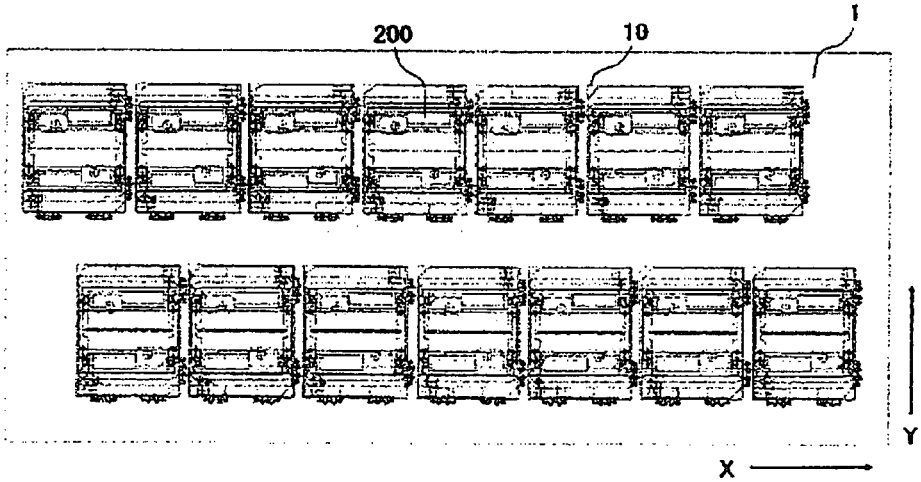
FIG. 2 is a plan view of an inkjet recording section.

FIG. 2 is a plan view of an inkjet recording section 100. The inkjet recording section 100 includes a plurality of head units 10 attached to a rectangular base plate 1 that is an attachment member. An inkjet heads 200 is attached to the head units 10 so that the ink discharge ports are aligned in parallel to the sub-scanning direction X. Furthermore, the respective head units 10 attached onto the base plate 1 are attached so that the ink discharge ports of the inkjet heads 200 attached onto the head units 10 adjacent to each other when viewed from the scanning direction Y somewhat overlap each other. By attaching such a plurality of head units 10, the base plate 1 can be handled as if the base plate were one large inkjet head. In this example, the head units of two rows×7 pcs are arranged so as to be displaced in the sub-scanning direction X. Moreover, the each head unit 10 has the two inkjet heads 200 mounted thereon. By using different types of ink for the two inkjet heads 200, recording can be performed with the two types of ink. If the ink discharge ports of the two inkjet heads 200 are disposed so as to be displaced from each other by a half as many as an interval between the ink discharge ports, recording can also be performed with a double density.

The each head unit 10 includes a plurality of inkjet heads each provided with drive means for discharging ink droplets corresponding to the each ink discharge port formed in the bottom face. The drive means generates an ink pressure fluctuation for discharging ink droplets to an ink channel communicating with the ink discharge port and includes, for example, a piezoelectric element or a heater. In addition, a drive circuit for controlling driving of the drive means is provided on a driving circuit board for each of the predetermined ink discharge ports, and the driving circuit board is mounted on the head unit 10.

Figure 3:
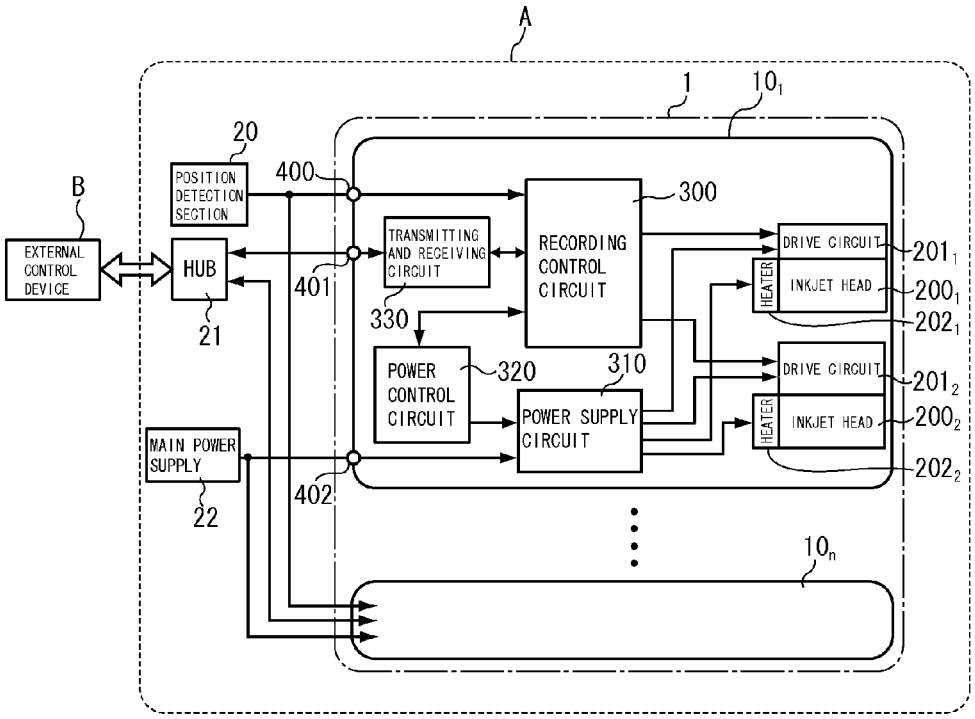
FIG. 3 is a schematic block diagram of recording control processing for performing recording operations in an inkjet recording apparatus.

FIG. 3 is a schematic block diagram of recording control processing for performing recording operations in an inkjet recording apparatus A. On the base plate 1, the head units $\mathbf{10}_1$-$\mathbf{10}_n$ having a quantity of n are mounted. On each of the head units $\mathbf{10}_{1\text{-}n}$, there is provided a set of a plurality of inkjet heads $\mathbf{200}_1$, a drive circuit $\mathbf{201}_1$ for driving the ink jet head $200_1$ and a heater $202_1$ for performing temperature control by heating the inkjet heads $200_1$, and the plurality of sets is mounted.

In addition, on the head unit 10, there are mounted a recording control circuit 300 for controlling recording of the drive circuit 201, a power supply circuit 310 for supplying electric power to the drive circuit 201 and the heater 202, a power control circuit 320 for controlling the power circuit based on a control signal from the recording control circuit 300, and a transmitting and receiving circuit 330 that is connected to a network to transmit/receive data, and that transmits recording control data to the recording control circuit 300. Then, electrical connection between respective circuits is performed arbitrarily by wiring or a wiring pattern. In this example, the drive circuit 201 is equivalent to a drive section, the recording control circuit 300 is equivalent to a recording control section, the power supply circuit 310 and the power control circuit 320 are equivalent to a power supply section, and a transmitting and receiving circuit 330 is equivalent to a transmitting and receiving section.

The recording control circuit 300 is mounted on one circuit board and executes recording control based on recording control data such as recording data, driving control data and recording position data to be transmitted from the transmitting and receiving circuit 330. That is, the recording control circuit transmits a control signal to the drive circuit 201 based on recording data and recording position data, to thereby drive the inkjet head, and transmits a control signal to the power control circuit 320 based on driving control data, to thereby control a driving voltage to be supplied from the power supply circuit 310 to the drive circuit 201. Furthermore, when a temperature state of the inkjet head is detected by a temperature detection sensor (not shown) and the temperature lowers, the recording control circuit transmits a control signal to the power control circuit 320 and supplies electric power from the power supply circuit 310 to the heater 202 for performing heating control.

The head unit 10 is provided with three connection terminals 400, 401 and 402. The connection terminal 400 is connected to the recording control circuit 300 and is connected to a position detection section 20 of the base plate 1 provided at the outside of the base plate 1 so that wiring is removable therebetween. The connection terminal 401 is connected to a transmitting and receiving circuit 330, and is connected to a hub section 21 provided at the outside of the base plate 1 so that wiring is removable therebetween. The connection terminal 402 is connected to the power supply circuit 310, and is connected to the main power supply 22 of the apparatus body so that wiring is removable therebetween.

The position detection section 20 detects a position of a recording medium along with a scanning operation in the Y direction by using a known position detector such as linear scale and generates a timing signal for determining a recording position. The timing signal generated by the position detection section 20 is transmitted to the recording control circuit 300 via the connection terminal 400 and is used for recording start processing.

The hub section 21 is connected with each transmitting and receiving circuit 330 of the head units $10_{1-n}$ through a network cable, and also connected with an external information processing apparatus B installed outside via a LAN network such as Ethernet (registered trademark). The external information processing apparatus B creates recording control data such as recording data, driving control data and recording position data, required for recording operations in the inkjet recording apparatus A, corresponding to each of the head units $10_{1-n}$ and transmits, via a network, recording control data created by adding an address allocated for each of head units $10_{1-n}$. The transmitted recording control data is received by each transmitting and receiving circuit 330 through the hub section 21, while the each transmitting and receiving circuit 330 acquires only recording control data added with an address corresponding to the head unit 10 and transmits the acquired recording control data to the recording control circuit 300.

In this manner, since the recording control data is transmitted to the head unit 10 through a network, the head unit 10 needs only the connection of a network cable, and thus cable connection is simplified. As the network cable, for example, a LAN cable may be used. Accordingly, maintenance work and the like of the inkjet head can be implemented with ease. In addition, because cables are detachably connected with the head unit 10 through a connection terminal, it is possible to flexibly deal with the increase/decrease in the head unit 10, and it is possible to facilitate replacement work even when some failure occurs in the head unit.

Even when a plurality of base plates 1 is arranged, it is possible to set network connection with ease through the hub section 21, and excellent expandability is achieved even in increasing the number of inkjet heads.

In addition, because the head units are connected through a network, it is also possible to connect external control apparatus via the Internet and it also becomes possible to perform recording operations by transmitting recording control data from an apparatus installed at a distant location.

Figure 4:
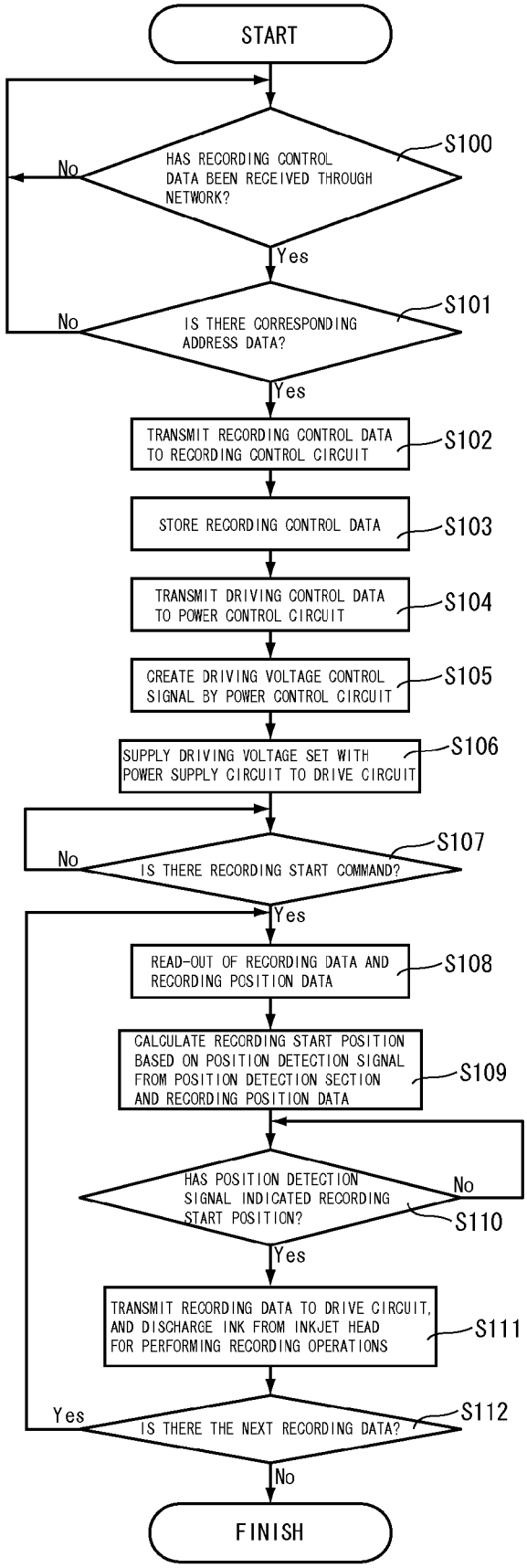
FIG. 4 is a processing flowchart in performing recording operations.

FIG. 4 is a processing flowchart in executing recording operations. First, the transmitting and receiving circuit 330 checks whether or not recording control data has been transmitted from the external information processing apparatus B through a network (S100), and when recording control data has been transmitted, checks whether or not added address data corresponds to the head unit (S101). When the address data is not a corresponding one, the flow returns to step S100, and when the address data is applicable, recording control data is acquired, which is then transmitted to the recording control circuit 300 (S102)

The recording control circuit 300 stores the transmitted recording control data (S103) and transmits the driving control data to the power control circuit 320 (S104). The power control circuit 320 generates a driving voltage control signal based on the transmitted driving control data (S105) and inputs the signal into the power supply circuit 310. The power supply circuit 310 supplies a driving voltage set based on the driving voltage control signal, to the driving circuit 201 (S106)

Next, it is checked whether or not a recording start command from the external information processing apparatus B has been transmitted (S107), and when the recording start command has been transmitted, recording data and recording position data are read (S108). Then, a recording start position is calculated based on a position detection signal from the position detection section 20 and recording position data (S109), and it is checked whether or not the position detection signal has corresponded to the recording start position (S110). When the signal has corresponded to the recording start position, recording data is transmitted to the drive circuit 201 and ink is discharged from each inkjet head for performing recording operations (S111). During a recording operation, the recording control circuit monitors a driving voltage supplied to the drive circuit in the recording control circuit, and when a failure exists, performs control so that the recording operation is stopped.

It is checked whether or not the next recording data exits (S112), and when the data exits, the process proceeds to a step S108 for performing the next recording operation. When the next recording data is not present, the process is completed.

INDUSTRIAL APPLICABILITY

As described above, each of the head units individually acquires the recording control data from the external information processing apparatus B through a network and performs a recording operation based on a position detection signal from the position detection section in accordance with a recording start command from the external information processing apparatus B, and thus a plurality of head units is controlled for performing precise recording operations. In addition, since the head unit can be easily increased, it becomes possible to respond to processing of recordings such as high-density recording, multi-color recording and large-sized image recording, which require a large amount of inkjet heads.

In the example described above, recording operations are performed based on the recording control data transmitted from the external information processing apparatus B, but a storage device connected with the recording control circuit may be mounted on the head unit 10, and all the recording control data required for recording operations may be acquired and once stored in the storage device. In this case, a removable storage medium, such as memory card or USB memory, may be used as the storage device, and after recording control data is stored in the storage medium from the external information processing apparatus B, the storage medium may be fitted on the inkjet recording apparatus. With such a structure, in the recording operations using a large amount of inkjet heads 200, high-speed recording operations can be achieved without being affected by a communication speed between the external information processing apparatus B and the recording control circuit. In performing more complicated and highly precise recording, the size of recording control data becomes large, and in some cases, the communication speed of the recording control data may become lower than the speed of recording operation. Even in such a case, if the storage device is connected with the recording control circuit to previously store recording control data, the speed of recording operation is not lowered.

Furthermore, as the recording control data, setting temperature data of the inkjet head may be also transmitted through a network. In the recording control circuit, the acquired setting temperature data and a detection signal from the temperature detection sensor disposed at the inkjet head are compared to each other and, if the detected temperature is different from the setting temperature data, a control signal is transmitted from the recording control circuit to the power control circuit, and the driving voltage supplied from the power circuit to the heater is adjusted. In adjusting the driving voltage, heating control may be performed by the fact that the driving voltage supplied from the power circuit to the heater is turned on and off, or the driving voltage is increased or decreased.

DESCRIPTION OF THE REFERENCE SYMBOLS

A INKJET RECORDING APPARATUS
B EXTERNAL INFORMATION PROCESSING APPARATUS
1 BASE PLATE
10 HEAD UNIT
20 POSITION DETECTION SECTION
21 HUB SECTION
22 MAIN POWER SUPPLY
100 INKJET RECORDING SECTION
101 CONVEYING BELT
102 CONVEYING ROLLER
200 INKJET HEAD
201 DRIVE CIRCUIT
202 HEATER
300 RECORDING CONTROL CIRCUIT
310 POWER SUPPLY CIRCUIT
320 POWER CONTROL CIRCUIT
330 TRANSMITTING AND RECEIVING CIRCUIT

The invention claimed is:

1. An inkjet recording apparatus, having a plurality of head units comprising:

a plurality of inkjet heads;

a plurality of drive sections being provided corresponding to the ink jet heads and drive-controlling inkjet operation;

a power supply section supplying, to each of the drive sections, a required voltage to perform the inkjet operation;

a recording control section controlling the plurality of drive sections and the power supply section, based on recording control data; and a transmitting and receiving section acquiring the recording control data via a network based on address data and transmitting the data to the recording control section, wherein the inkjet recording apparatus discharges ink droplets from the inkjet heads based on the recording control data transmitted to the head units via the network, to thereby perform recording on a recording medium, wherein, each head unit is provided with the connection terminal which is connected to a hub section provided at an outside portion of a base plate so that a network cable is removable therebetween, wherein a plurality of the head units are mounted on the base plate;

wherein the hub section is connected with an external information processing apparatus via the network; and wherein the recording control data is created by adding an address allocated for each of head units.

2. The inkjet recording apparatus according to claim 1, wherein a LAN cable is connected to the head unit to perform data transmission and reception via a network.

3. The inkjet recording apparatus according to claim 1, wherein the power supply section supplies electric power to a heater provided on the inkjet head and adjusts a temperature of the inkjet head.

4. The inkjet recording apparatus according to claim 1, wherein a storage device for once storing the recording control data is mounted on the head unit.

5. The inkjet recording apparatus according to claim 2, wherein the power supply section supplies electric power to a heater provided on the inkjet head and adjusts a temperature of the inkjet head.

6. The inkjet recording apparatus according to claim 2, wherein a storage device for once storing the recording control data is mounted on the head unit.

7. The inkjet recording apparatus according to claim 3, wherein a storage device for once storing the recording control data is mounted on the head unit.

* * * * *